US007123873B2

(12) United States Patent
deJong et al.

(10) Patent No.: US 7,123,873 B2
(45) Date of Patent: Oct. 17, 2006

(54) PRINTING SYSTEM WITH INVERTER DISPOSED FOR MEDIA VELOCITY BUFFERING AND REGISTRATION

(75) Inventors: Joannes N. M. deJong, Hopewell Junction, NY (US); Lloyd A. Williams, Mahopac, NY (US); Barry Paul Mandel, Fairport, NY (US); James L. Giacobbi, Penfield, NY (US); Steven Robert Moore, Rochester, NY (US); Stan Alan Spencer, Rochester, NY (US); Carlos Manuel Terrero, Ontario, NY (US); Ming Yang, Fairport, NY (US); Carl B. Lewis, Webster, NY (US); Lisbeth S. Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 153 days.

(21) Appl. No.: 10/924,113

(22) Filed: Aug. 23, 2004

(65) Prior Publication Data

US 2006/0039728 A1 Feb. 23, 2006

(51) Int. Cl.
*G03G 15/00* (2006.01)

(52) U.S. Cl. ..... 399/381; 399/365; 399/367; 399/383; 399/390; 399/391; 399/396; 399/397

(58) Field of Classification Search ..... 399/381, 399/391, 390, 383, 396, 397, 365, 367
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Andrew H. Hirshfeld
*Assistant Examiner*—Marvin P. Crenshaw
(74) *Attorney, Agent, or Firm*—Fay, Sharpe, Fagan, Minnich & McKee, LLP

(57) ABSTRACT

Parallel printing systems and methods incorporate inverter assemblies for not only inverting media during transport through the system but also to register the media or provide a velocity buffer transports with different drive velocities. The inverter assemblies can include the capability to optionally deskew the media and provide lateral registration corrections. The inverter assembly nip rollers are sufficiently spaced from process drive nip rollers to decouple a document in the inverter assembly from the highway paths. The method comprises combining the inverting function selectively with either the registering or the velocity buffering functions.

9 Claims, 5 Drawing Sheets

U.S. PATENT DOCUMENTS 5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel
5,963,770 A * 10/1999 Eakin ..... 399/364
5,995,721 A 11/1999 Rourke et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 * 9/2002 Conrow ..... 400/582
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B1 4/2003 Stoll
6,554,276 B1 4/2003 Jackson et al.
6,577,925 B1 6/2003 Fromherz
6,607,320 B1 8/2003 Bobrow et al.
6,608,988 B1 * 8/2003 Conrow ..... 399/364
6,612,566 B1 9/2003 Stoll
6,612,571 B1 9/2003 Rider
6,621,576 B1 9/2003 Tandon et al.
6,633,382 B1 10/2003 Hubble, III et al.
6,639,669 B1 10/2003 Hubble, III et al.
6,819,906 B1 11/2004 Herrmann et al.
2002/0078012 A1 6/2002 Ryan et al.
2002/0103559 A1 8/2002 Gartstein
2003/0077095 A1 * 4/2003 Conrow ..... 399/364
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel, et al.
U.S. Appl. No. 10/785,211, filed Feb. 24, 2004, Lofthus, et al.
U.S. Appl. No. 10/881,619, filed Jun. 30, 2004, Bobrow.
U.S. Appl. No. 10/917,676, filed Aug. 13, 2004, Lofthus, et al.
U.S. Appl. No. 10/917,768, filed Aug. 13, 2004, Lofthus, et al.
U.S. Appl. No. 10/924,106, filed Aug. 23, 2004, Lofthus, et al.
U.S. Appl. No. 10/924,113, filed Aug. 23, 2004, deJong, et al.
U.S. Appl. No. 10/924,458, filed Aug. 23, 2004, Lofthus, et al.
U.S. Appl. No. 10/924,459, filed Aug. 23, 2004, Mandel, et al.
U.S. Appl. No. 10/933,556, filed Sep. 3, 2004, Spencer, et al.
U.S. Appl. No. 10/953,953, filed Sep. 29, 2004, Radulski, et al.
U.S. Appl. No. 10/999,326, filed Nov. 30, 2004, Grace, et al.
U.S. Appl. No. 10/999,450, filed Nov. 30, 2004, Lofthus, et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001,890, filed Dec. 2, 2004, Lofthus, et al.
U.S. Appl. No. 11/002,528, filed Dec. 2, 2004, Lofthus, et al.
U.S. Appl. No. 11/051,817, filed Feb. 4, 2005, Moore, et al.
U.S. Appl. No. 11/070,681, filed Mar. 2, 2005, Viturro, et al.
U.S. Appl. No. 11/081,473, filed Mar. 16, 2005, Moore.
U.S. Appl. No. 11/069,020, filed Feb. 28, 2005, Lofthus, et al.
U.S. Appl. No. 11/089,854, filed Mar. 25, 2005, Clark, et al.
U.S. Appl. No. 11/090,498, filed Mar. 25, 2005, Clark.
U.S. Appl. No. 11/090,502, filed Mar. 25, 2005 Mongeon.
U.S. Appl. No. 11/095,378, filed Mar. 31, 2005, Moore, et al.
U.S. Appl. No. 11/094,998, filed Mar. 31, 2005, Moore, et al.
U.S. Appl. No. 11/094,864, filed Mar. 31, 2005, de Jong, et al.
U.S. Appl. No. 11/095,872, filed Mar. 31, 2005, Julien, et al.
U.S. Appl. No. 11/102,355, filed Apr. 8, 2005, Fromherz, et al.
U.S. Appl. No. 11/084,280, filed Mar. 18, 2005, Mizes.
U.S. Appl. No. 11/109,566, filed Apr. 19, 2005, Mandel, et al.
U.S. Appl. No. 11/109,558, filed Apr. 19, 2005, Furst, et al.
U.S. Appl. No. 11/109,996, filed Apr. 20, 2005, Mongeon, et al.
U.S. Appl. No. 11/093,229, filed Mar. 29, 2005, Julien.
U.S. Appl. No. 11/102,899, filed Apr. 8, 2005, Crawford, et al.
U.S. Appl. No. 11/102,910, filed Apr. 8, 2005, Crawford, et al.
U.S. Appl. No. 11/115,766, filed Apr. 27, 2005, Grace.
U.S. Appl. No. 11/120,589, filed May 3, 2005, Contino.
U.S. Appl. No. 11/102,332, filed Apr. 8, 2005, Hindi, et al.

* cited by examiner

PRINTING SYSTEM WITH INVERTER DISPOSED FOR MEDIA VELOCITY BUFFERING AND REGISTRATION

BACKGROUND

The present exemplary embodiments relate to media (e.g., document or paper) handling systems and systems for printing thereon and is especially applicable for a printing system comprising a plurality of associated marking engines.

The subject application is related to the following copending applications: U.S. Ser. No. 10/924,106, for "Printing System with Horizontal Highway and Single Pass Duplex"; U.S. Ser. No. 10/924,459, for "Parallel Printing Architecture Consisting of Containerized Image Marking Engine Modules"; and U.S. Ser. No. 10/924,458, for "Print Sequence Scheduling for Reliability".

Printing systems including a plurality of marking engines are known and have been generally referred to as tandem engine printers or cluster printing systems. See U.S. Pat. No. 5,568,246. Such systems especially facilitate expeditious duplex printing (both sides of a document are printed) with the first side of a document being printed by one of the marking engines and the other side of the document being printed by another so that parallel printing of sequential documents can occur. The process path for the document usually requires an inversion of the document (the leading edge is reversed to become the trailing edge) to facilitate printing on the back side of the document. Inverter systems are well known and essentially comprise an arrangement of nip wheels or rollers which receive the document by extracting it from a main process path, then direct it back on to the process path after a 180° flip so that what had been the trailing edge of the document now leaves the inverter as the leading edge along the main process path. Inverters are thus fairly simple in their functional result; however, complexities occur as the printing system is required to handle different sizes and types of documents and where the marking engines themselves are arranged in a parallel printing system to effect different types of printing, e.g., black only printing versus color or custom color printing.

As a document is transported along its process path through the system, the document's precise position must be known and controlled. The adjustment of the documents to desired positions for accurate printing is generally referred to as a registering process and the apparatus used to achieve the process are known as registration systems. Precision registration systems generally comprise nip wheels in combination with document position sensors whereby the position information is used for feedback control of the nip wheels to adjust the document to the desired position. It can be appreciated that many registration systems require some release mechanism from the media handling path upstream of the nip registration wheels so that the wheels can freely effect whatever adjustment is desired. This requires a relatively long and expensive upstream paper handling path. In parallel printing systems using multiple marking engines, the required registration systems also adds to the overall media path length. As the number of marking engines increases, there is a corresponding increase in the associated inverting and registering systems. As these systems may be disposed along the main process path, the machine size and paper path reliability are inversely affected by the increased length of the paper path required to effectively release the documents for registration.

Another disadvantageous complexity especially occurring in parallel printing systems is the required change in the velocity of the media/document as it is transported through the printing system. As the document is transported through feeding, marking, and finishing components of a parallel printing system, the process speed along the media path can vary to a relatively high speed for transport along a highway path, but must necessarily be slowed for some operations, such as entering the transfer/marking system apparatus. Effective apparatus for buffering such required velocity changes also requires an increase in the main process path to accommodate document acceleration and deceleration between the different speed sections of the process path.

Especially for parallel printing systems, architectural innovations which effectively shorten the media process path, enhance the process path reliability and reduce overall machine size are highly desired.

BRIEF SUMMARY

The proposed development comprises an inverter disposed in a parallel printing system for accomplishing necessary document handling functions above and beyond the mere document inversion function. The combined functions also include velocity buffering and registration within the inverter assembly for yielding a more compact and cost effective media path.

The velocity buffering occurs when a document is received from a main highway path when the document is traveling at a higher speed and then transported into a marking engine at a slower speed. Thus, the ingress to the inverter is at one speed, while the egress is at a second speed. Such an operating function would normally be accomplished at the entrance to the image transfer zone of the marking component. Alternatively, the inverter could perform an opposite velocity buffering function, the ingress could be at a low speed, while the egress would be at a higher speed. Such an operating function could normally be expected to occur at the exit of the marking engine.

A second combined function of the inverter apparatus is performing a document registration while the document is in the inverter assembly. The inverter assembly effectively decouples the document from the media process path so that only the inverter holds the document independently of the process path nip rollers. The inverter nips then can be controlled to deskew or laterally shift the document, thereby effectively completing all the necessary registration functions while simultaneously accomplishing an inverting function.

Alternative embodiments can effectively combine all three functions, inverting, velocity buffering and registering in the same inverter assembly for even more enhanced efficiency and size reductions in the paper handling path and overall machine size.

Another embodiment comprises the method of processing the document for transport through a printing system for enhancing document control and reducing transport path distance. The printing system includes an inverter assembly comprising a variable speed drive motor associated with nip drive rollers for grasping the document. The system also includes a marking engine. The method comprises transporting a document into the inverter assembly at a first speed, inverting the document in the inverter assembly, and transporting the document out of the inverter assembly in a second speed whereby a variance between the first and second speeds is buffered by the inverter assembly.

Advantages of the exemplary embodiments result from the combined processing functions of inversion, registration and velocity buffering for effectively shortening the document process path through a printing system, thereby reducing the overall machine size and enhancing the process path reliability.

DETAILED DESCRIPTION OF THE EXEMPLARY EMBODIMENTS

Figure 1:
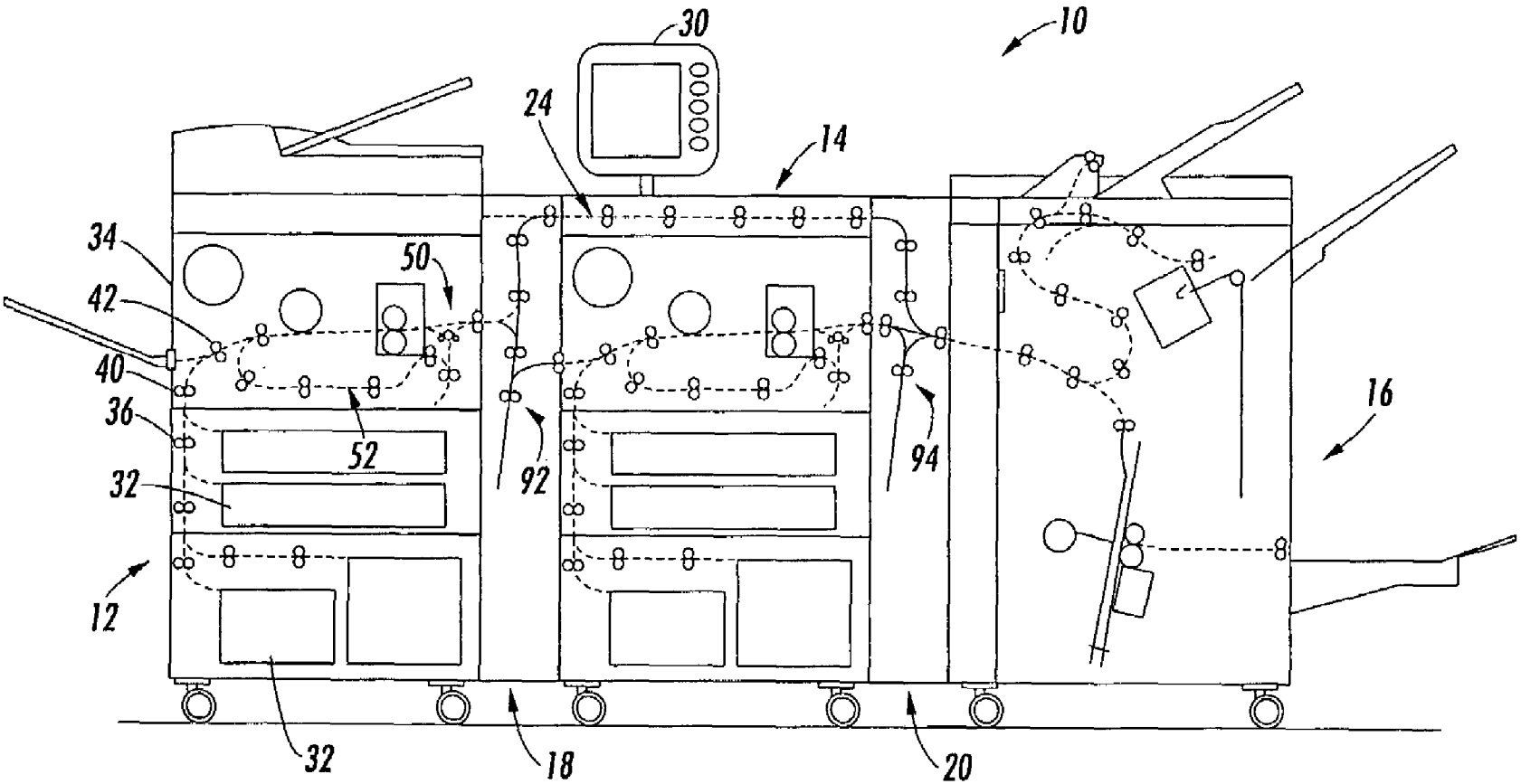
FIG. 1 shows a schematic view of a printing system illustrating selective architectural embodiments of the subject developments.

With reference to the drawings wherein the showings are for purposes of illustrating alternative embodiments and not for limiting same, FIG. 1 shows a schematic view of a printing system comprising a plurality of marking engines associated for tightly integrated parallel printing of documents within the system. More particularly, printing system 10 is illustrated as including primary elements comprising a first marking engine 12, a second marking engine 14 and a finisher assembly 16. Connecting these three elements are three transport assemblies 18, 24 and 20. The document outputs of the first marking engine 12 can be directed either up and over the second marking engine 14 through horizontal by-pass path 24 and then to the finisher 16. Alternatively, where a document is to duplexed printed, the first vertical transport 18 can transport a document to the second marking engine 14 for duplex printing. The details of practicing parallel simplex printing and duplex printing through tandemly arranged marking engines are known and can be generally appreciated with reference to the foregoing cited U.S. Pat. No. 5,568,246. In order to maximize marking paper handling reliability and to simplify system jam clearance, the marking engines are often run in a simplex mode. The sheets exit the marking engine image-side up so they must be inverted before compiling in the finisher 16. Control station 30 allows an operator to selectively control the details of a desired print job.

The marking engines 12, 14 shown in FIG. 1 are conventional in this general illustration and include a plurality of document feeder trays 32 for holding different sizes of documents that can receive print markings by the marking engine portion 34. The documents are transported to the marking engine portion along a highway path 36 which is common to a plurality of the trays 32. It is to be appreciated that any document or media transport path within any of the alternative embodiments outside of the image transfer zone of the marking engine should be considered a high speed highway of document transports. By "highway" path portions is meant those document transport paths where the document is transported at a relatively high speed. For example, in a parallel printing system the sheets are transported through the marking engines at an optimum velocity, but in order to merge the sheets from two or more marking engines together without overlapping them, the sheets must be accelerated up to a higher velocity. A similar situation occurs when providing a stream of blank media to two or more marking engines. The velocity of the highways is therefore generally higher than the velocity used in the marking engines. A plurality of nip drive rollers associated with process direction drive motors (not shown), position sensors (not shown) and their associated control assemblies (belts, guide rods, frames, etc., also not shown) cause the transport of documents through the system at the selected highway speed. Documents printed by the marking engine generally must be transported at a slower speed than the highway through the image transfer zone of the marking engine. The image transfer zone can be considered to be that portion of the marking engine 34 in which some portion of the sheet is in the process of having an image transferred to it and in some marking engines, fused. Each marking engine 12, 14 is shown to include an inverter assembly 50 conventionally known as useful for duplex printing of a document by the same engine. More particularly, after one side of a document is printed, it is transported to the inverter assembly 50 where it is inverted and then communicated back to the image transfer zone by duplex path 52.

Figure 2:
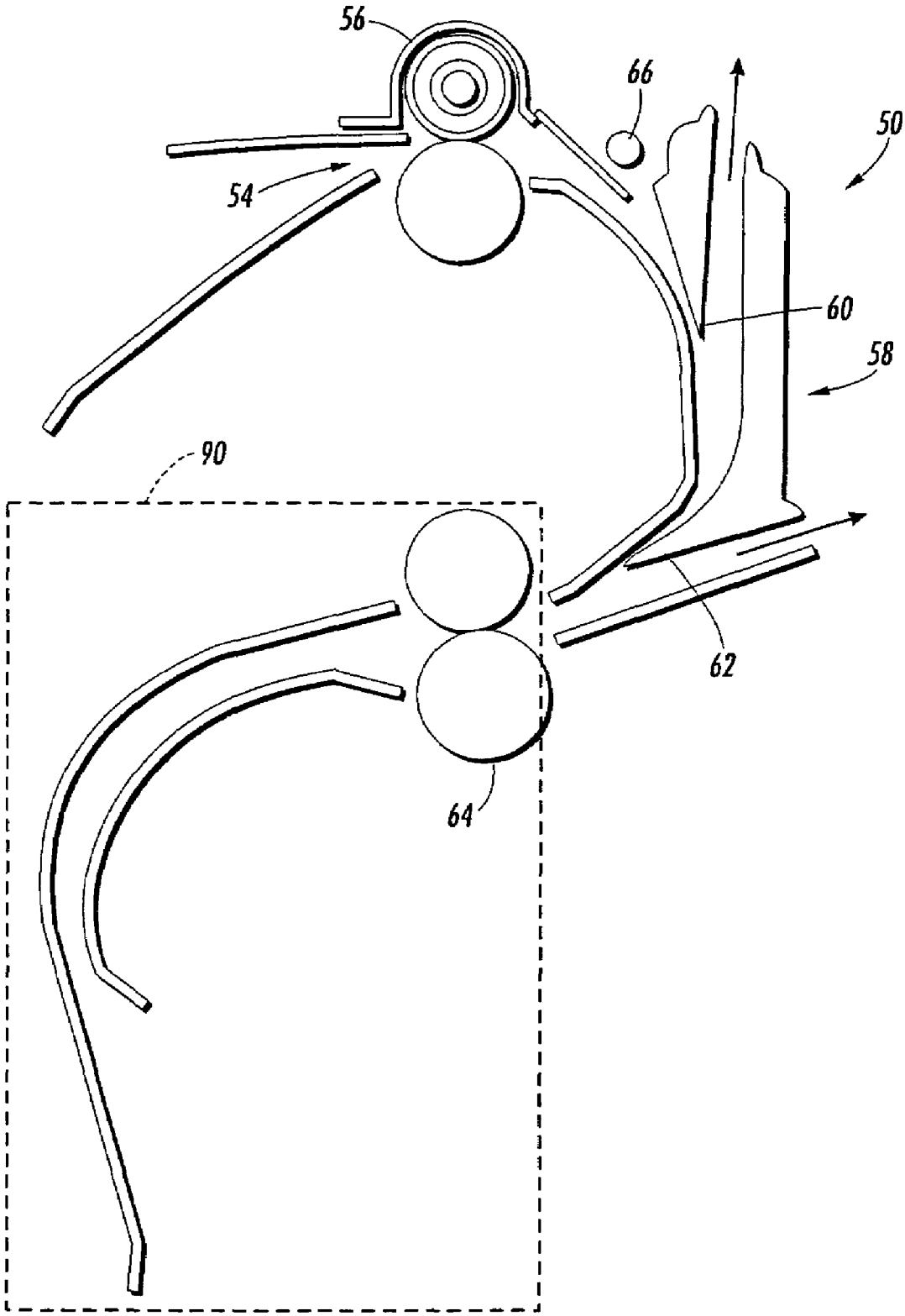
FIG. 2 is a schematic cross-sectional illustration of an inverter assembly as may be employed within the system of FIG. 1.

With reference to FIG. 2, a more detailed view of an inverter assembly 50 is shown in schematic cross-section. A document transported into the inverter assembly at sheet entrance 54 is grasped by inverter assembly input nip rollers 56 and communicated through a gate assembly 58 past simplex gate 60 and duplex gate 62 into the reversing roll nips 64. Sensor 66 identifies when a document that is received in the inverter assembly has cleared the inverter nip rollers 56, so that it can be exclusively grasped by the reversing nip rollers 64 and thereby effectively decoupled from the upstream paths from the sheet entrance 54, whether they be the highway path or an image transfer zone path. More importantly, when a document is exclusively grasped by the reversing nip rollers 64, its speed can be set independent of the speed with which the document is received at the inverter nip rollers 56. The reversing nip rollers 64 can be driven in a different speed when the document is released by the inverter nip rollers 56 to enable a velocity buffering between desired different speeds about the inverter assembly as will hereinafter be more fully explained.

Figure 3A:
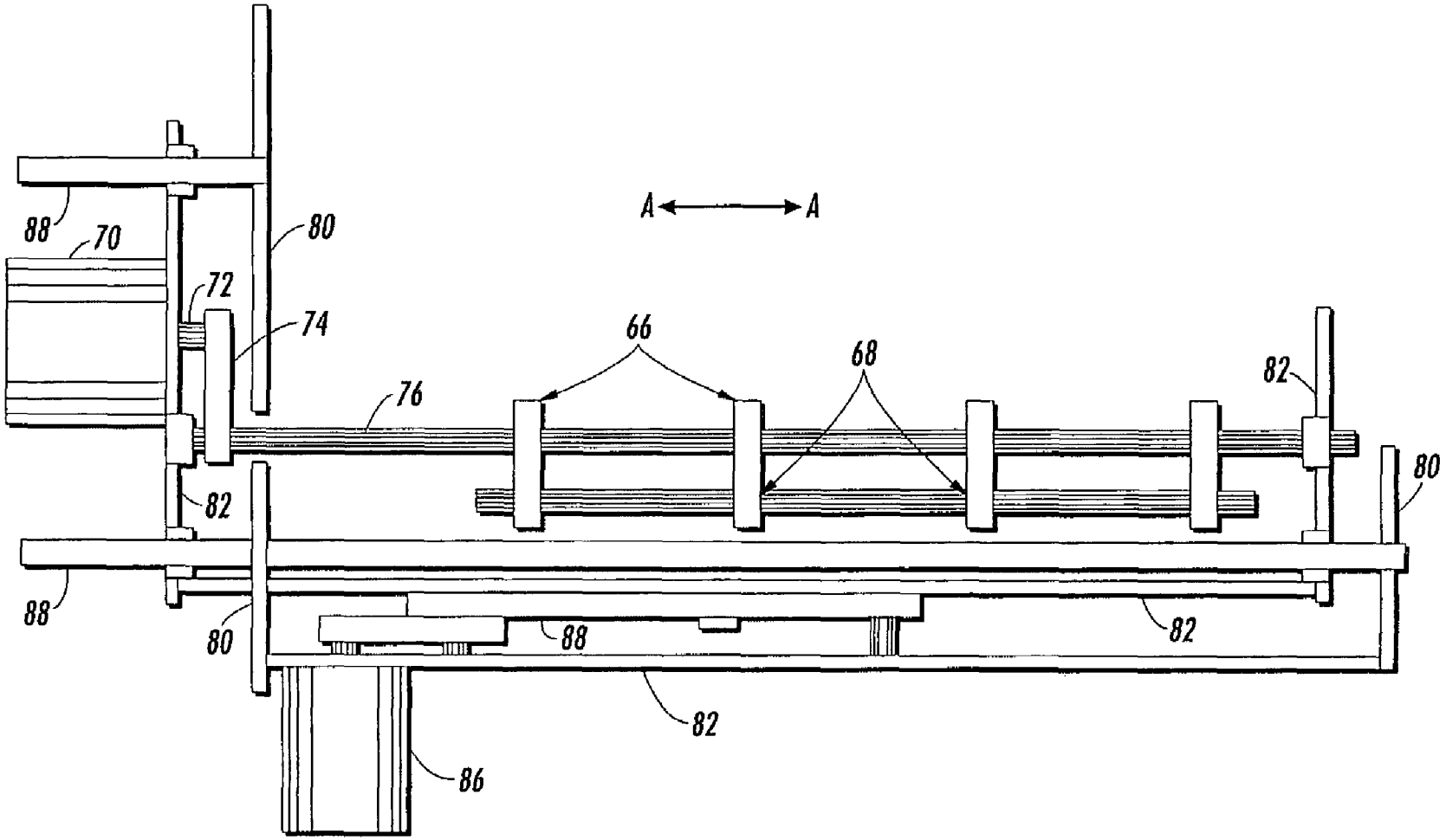
FIG. 3*a* is an elevated view of a portion of the inverter assembly of FIG. 2, more particularly illustrating a translating portion thereof.

FIG. 3*a* is a partial elevated view of the inverter assembly of FIG. 2 more particularly illustrating the details of the subject embodiment of the inverter assembly and with particular illustration of the drive mechanisms for the reversing nip rollers 64. A plurality of reversing nip rollers 64 comprise nip drive rollers 66 and opposed nip idler rollers 68 which together serve to grasp the document being transferred between the rollers 66, 68. A reversible variable speed process direction motor 70 controls the speed of the drive rollers as the motor shaft 72 drives process direction belt drive 74, thereby turning the drive rollers 66 mounted on shaft 76. A solenoidal release mechanism (not shown) can selectively release ones of the nip idler rollers from grasping engagement with the drive rollers 66 to enable overlap of sheets during the inversion operation for higher speed processing. The stationary frame 80 supports a substantial portion of the inverter assembly against process direction movement, but allows the process direction motor as mounted in a translating frame 82 to be moved in a cross-process direction for adjusting the position of a document within the inverter assembly to accomplish the registering function. More particularly, a translating drive motor 86 mounted on the stationary frame 80 is connected to the translating carriage frame 82 via belt drive 88 for translating nip drive roller 66, nip idler rollers 68 and the other elements mounted on the translating frame 82 in a cross-process direction by sliding the guide rods 88 supporting the translating frame 82 within the stationary frame 80. In other words, as the translating motor 86 moves the translating frame 82 supported by guide rods 88, the guide rods 88 will correspondingly translate through the stationary frame 80 in a directional manner shown by arrow "A—A".

With reference to FIG. 2, it can be seen that the entire translating portion shown as shown in FIG. 3*a* comprises only a portion 90 of the overall inverter assembly 50. In the subject embodiment, single reversing nip rollers can be used for both of the inverting and registering process either during the ingress of a document to the translating portion 90, its egress therefrom, or during both ingress and egress. The registering comprises both laterally shifting of the document via the cross-process translating of the translating frame 82, or deskewing of the documents by driving the drive nips at a differential velocity. The details of a deskewing operation via differential nip drive mechanisms are better shown in FIG. 3*b*.

Figure 3B:
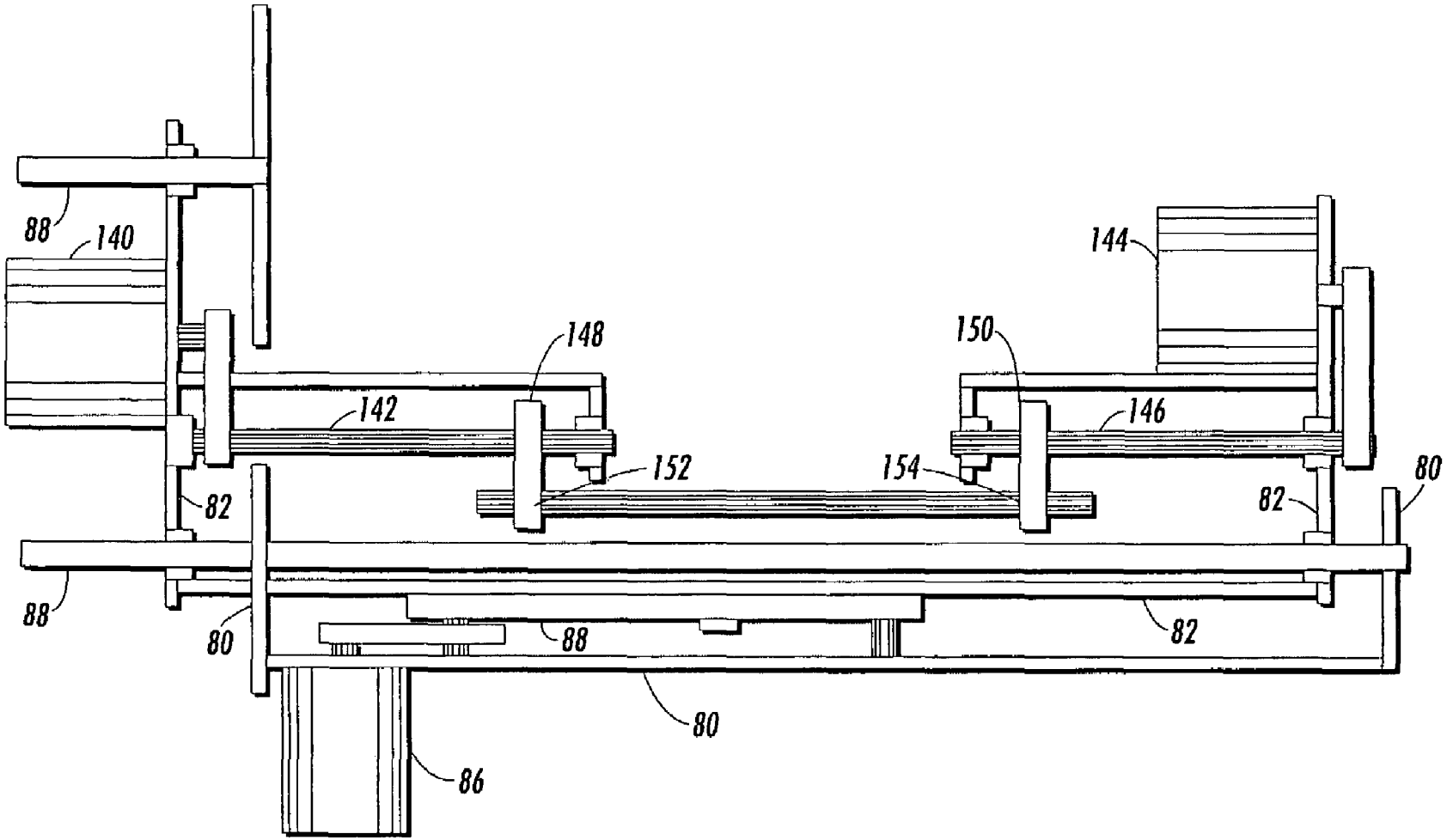
FIG. 3*b* is an elevated view of an inverter nip assembly as shown in FIG. 2 that also includes the capability to deskew and translate media during the inversion process.

In FIG. 3*b*, the nip drive roller shaft 76 of FIG. 2 has been modified into two different nip drive roller shafts each independently driven by separate motors to effect the desired deskewing operation. More particularly, first nip process direction motor 140 effectively drives first nip drive roller shaft 142 and a second nip process direction motor 144 drives second nip drive roller shaft 146. Nip drive rollers 148, 150 are mounted respectively on the shafts opposite nip idler rollers 152, 154 so that a sheet grasped between the nip drive rollers 148, 150 and nip idler rollers 152, 154 can be deskewed when the motors 140, 144 drive the rollers 148, 150 at different speeds. The lateral shift in translation components of the assembly in FIG. 3*b* remain the same as in FIG. 3*a*.

The examples depicted in FIGS. 3*a* and 3*b* show how deskew and lateral registration functions could be accomplished using the same nip drive system used to invert the sheets. There are many other mechanisms that can be used to register media that could be combined with the functions of an inverter in a similar fashion. Some alternative registration structures and methods include; performing media lateral translation by translating the drive nips and shafts without translating the structural frame, providing deskew and lateral media translation using a pair of drive nips that can be driven independently, angled or steered similar to the front wheels of a car, or using spherical nips to drive and register the media. These registration mechanisms are all well known and are described in previous Xerox patents. The key idea presented here is that the combination of the registration and inverter functions provides distinct advantages in terms of cost and space, and that many different methods of media registration can be used.

The advantages of an inverter assembly capable of performing registering and/or velocity buffering functions simultaneously, while accomplishing an inverting function provides numerous alternative advantageous architectures in parallel printing systems.

With reference to FIG. 1, it can be seen that the vertical transport modules 18 and 20 both include inverter assemblies 92, 94, while the marking engines 12–14 each include additional inverter assemblies 50 adjacent the exit to the image transfer zone. The disposition of such a plurality of inverter assemblies within the overall printing system provides options for implementing desired registering and velocity buffering of documents being transported through the system. For example, assume the system of FIG. 1 had the following architectural and operational constraints: 1) the marking engines 12, 14 are document outboard edge registered; 2) the finishing module 16 is document centered registered; 3) the first marking engine 12 cross-process exit location has a tolerance of plus/minus 9 millimeters; and 4) the second marking engine 14 has a cross-process entrance allowable tolerance of plus/minus 1 millimeter. These constraints require the following actions to be taken for the following system capabilities. To deliver a document from the first marking engine 12, to the finishing module 16, document registration requires shifting the sheet from upward edge registration to center registration. The required cross-process action can be accomplished through inverting the sheet at inverter assembly 92 while effecting the required cross-process action registration. Alternatively, one can appreciate that the document may be fed to the inverter assembly 92 from the first marking engine 12 at a marking engine speed, but when grasped fully by the inverter assembly 92 and thereby free of the upstream nip rollers of the marking engine 12, the variable speeds motor 70 of inverter assembly 92, can adjust the document transport speed to a highway speed for transport from the first vertical transport module 18 through the bypass highway 14, through the second vertical transport module 20 and to the finishing module 16. Thus, inverter assembly 92 acts as a velocity buffer between the slower marking engine speed of the first marking engine 12 and the highway speed of the transport modules 18, 20 and the bypass module 14. Where system capability requires delivering a sheet from the second marking engine 14 to the finishing module 16, a similar cross-process action is required to adjust registration from upward edge to center registration. Similarly, the inverter assembly 94 of second vertical transport module 20 can accomplish the required inversion in the inverter assembly 94 while simultaneously accomplishing the velocity buffering between the second marking engine 14 and the highway speed transport processing of the second vertical transport module 20 and the finishing module 16. When the print job requires delivering sheets from the first marking engine 12 to the second marking engine 14 as, for example, to effect duplex printing on the sheet, the required cross-process action is to realign the sheet in the inverter assembly 92 of the first vertical transport module 18 with respect to the second marking engine 14 registration data. Thus, inverter assembly 92 not only inverts the sheet for printing the second side of the document in the second marking engine, but the registration process is also accomplished in the inverter assembly 92.

The foregoing architectural embodiments describe an inverter assembly that performs the above inversion and cross-process actions within a very compact architectural envelope. The inverter assemblies 92, 94 use a convention reversing roll nip structure as the active inverting element. As a document enters the inverter assembly 92, 94, the reversing roll nip 64 takes control of the document and drives it in a forward direction until the sheet trailing edge reaches a predetermined stop location. The stop location is located slightly past a gate feature such as the duplex gate 62. The variable speed reversing process direction motor then stops and reverses the document transport direction, driving the document in a reverse direction from the reversing roll nips 64. The new lead edge of the document passes by the gate feature, either duplex gate 62 or simplex gate 60, so it exits the inverter assembly 50 in a different path than the input path.

Figure 4:
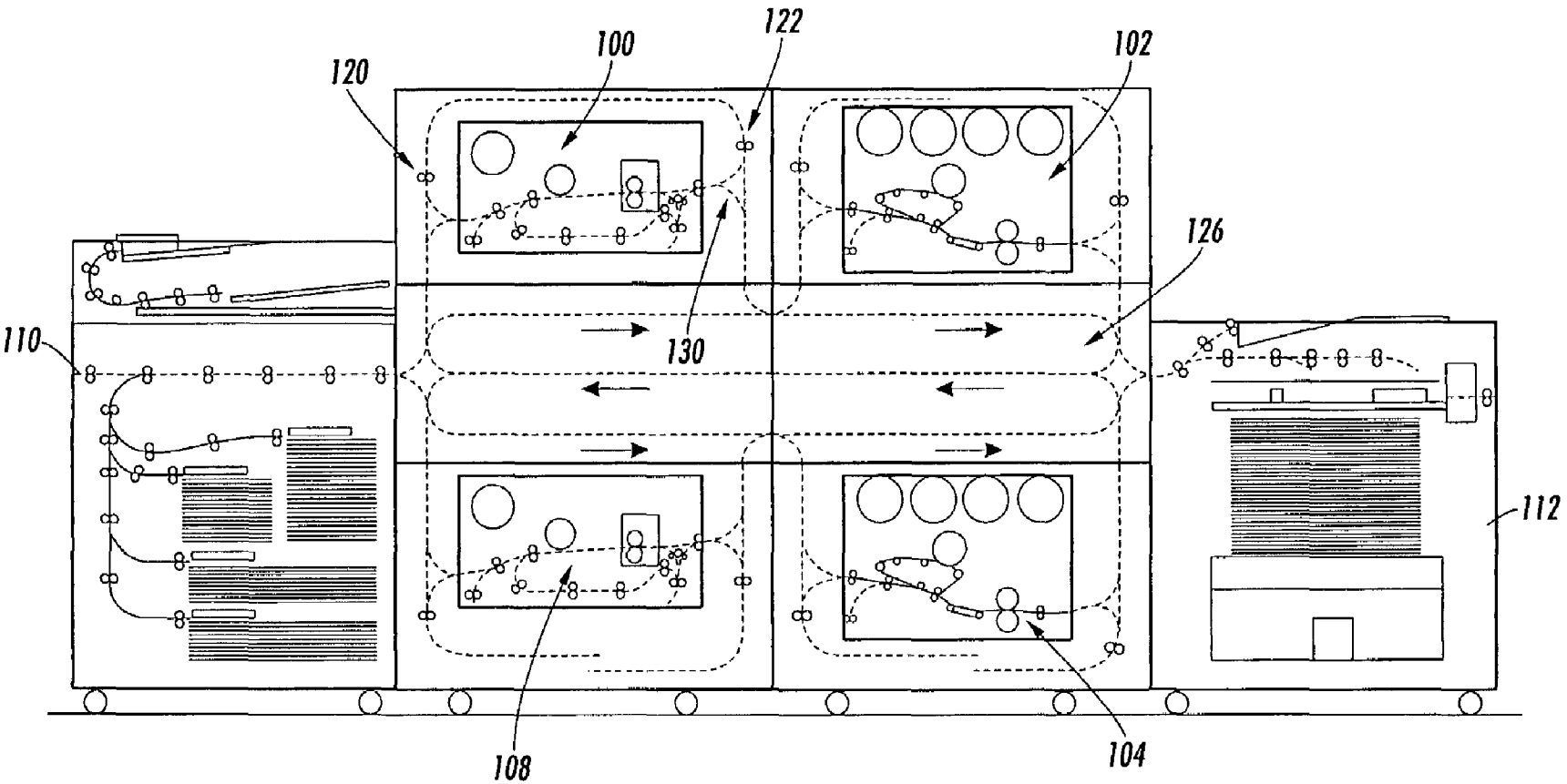
FIG. 4 is an alternative embodiment of a printing system showing alternative architectures of inverter assembly dispositions within the system.

With reference to FIG. 4, another tightly integrated parallel printing system architecture is illustrated, particularly showing alternative dispositions of inverter assemblies as velocity buffers between high speed highways and the marking engines. In this system, the inverters could also optionally include registration capability. In the architecture of FIG. 4, four marking engines 100, 102, 104, and 108 are shown interposed between a feeder module 110 and a finishing module 112. The marking engines can be different types of marking engines, i.e., black only, custom color or color, for high speed parallel printing of documents being transported through the system. Each marking engine has a first inverter assembly 120 adjacent an entrance to the marking engine 100 and an exit inverter assembly 122 adjacent an exit of the marking engine. As noted above, as the document is being processed for image transfer through the marking engine 100, the document is transported at a relatively slower speed, herein referred to as engine marking speed. However, when outside of the marking engine 100, the document can be transported through the interconnecting high speed highways at a relatively higher speed. In inverter assembly 120 a document exiting the highways 126 at a highway speed can be slowed down before entering marking engine 100 by decoupling the document at the inverter from the highways 126 and by receiving the document at one speed into the inverter assembly, adjusting the reversing process direction motor speed to the slower marking engine speed and then transporting the document at slower speed to the marking engine 100. Additionally, if a document has been printed in marking engine 100, it exits the marking engine at the marking engine speed and can be received in the exit inverter assembly 122 at the marking engine speed, decoupled from the marking engine and transported for re-entering the high speed highway at the highway speed. Alternatively, it is within the scope of the subject embodiments to provide additional paper paths 130 to bypass the input or exit inverter assemblies. Additionally, as noted above, any one of the inverter assemblies shown in any of the architectures could also be used to register the document in skew or in a lateral direction.

Alternative embodiments of the inverter assembly comprise maintaining separate nip rollers for the inverter and the registration functions (not shown). For example, a registration function could be performed by the input nip rollers 56 when the inverter nip rollers 64 are opened. Since many inverter systems already include a nip release, there is no cost penalty if the registration function is done at the entrance or exit of the inverter such that the inverter nip must be released during the registration process. Such a configuration maintains the important feature mentioned above of requiring no additional nip releases during sheet registration, while providing additional flexibility in terms of document path design and routing.

The subject embodiments enable very high registration latitudes (deskew, top edge registration and lead edge registration), since corrections can be made while a sheet both enters and exits the inverter assembly. By the nature of the inversion process, sheets entering the inverter assemblies are registered using the lead edge of the sheet (the lead edge becomes the trailing edge when it exits) to correct for any feeding/transporting registration errors. The removal of skew and lateral registration errors could be done while the sheet enters and exits the inverter, or the primary errors could be removed during the entrance phase and additional top edge and skew corrections could be made as the sheet exits the inverter (to correct for cut sheets and trailing edge/leading edge registration induced errors). Such a capability puts less stringent registration requirements on the feeders and other transports and thereby lowers overall system costs and enhances system reliability and robustness.

The exemplary embodiments have been described with reference to the specific embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A printing system including a marking engine and an inverter wherein the inverter is disposed within a translation stage assembly and includes a registration system for defining and adjusting of system media position and wherein the inverter includes a reversing roll nip assembly disposed within the translation stage assembly and wherein the translation stage assembly includes a translating frame, a nip process direction motor, a nip drive roller and a translation motor, wherein the translation motor is associated with a frame drive connected to the translating frame for selectively positioning the translating frame, the nip process direction motor and the nip drive roller for the adjusting of media position.

2. The printing system of claim 1 wherein the inverter comprises a reversing roll nip assembly includes a plurality of nip drive rollers, opposed nip idler rollers and a nip release mechanism for selectively disengaging ones of the drive or idler rollers from document grasp.

3. The printing system of claim 1 wherein the inverter drive nip system includes at least two drive nip assemblies that can be driven with a differential velocity so as to deskew the media and in a reverse direction to perform an inverting function.

4. The printing system of claim 1 wherein the inverter drive nip system can be translated in a cross process direction.

5. The system of claim 1 wherein the inverter drive nip system includes at least two drive nip assemblies that can be driven with a differential velocity so as to deskew the media and in a reverse direction to perform an inverting function, and the nip assemblies can be translated to register media in a cross process direction.

6. The system of claim 1 wherein the media registration is performed by a drive nip system adjacent to an inverter nip system.

7. The system of claim 6 in which the inverter nip system is released during the media registration.

8. The printing system of claim 1 wherein the adjusting comprises at least one of cross-process translating, deskewing and process direction translating.

9. The printing system of claim 1 further including an input nip roller and at least one input sensor disposed adjacent the input nip roller for defining media position relative to the input nip roller for independent media control by the translation stage assembly.

* * * * *